United States Patent [19]

Okabayashi et al.

[11] Patent Number: 4,613,244

[45] Date of Patent: Sep. 23, 1986

[54] DEVICE FOR MOUNTING PRINTING TYPE ARRAY ON PRINTER

[75] Inventors: Mitumasa Okabayashi; Norio Shiga, both of Tokyo, Japan

[73] Assignee: Tokyo Juki Industrial Co., Ltd., Tokyo, Japan

[21] Appl. No.: 599,992

[22] Filed: Apr. 13, 1984

[51] Int. Cl.[4] ..... B41J 1/30

[52] U.S. Cl. ..... 400/175; 400/144.2

[58] Field of Search ..... 400/144.2, 175

[56] References Cited

U.S. PATENT DOCUMENTS 4,310,255 1/1982 Asano et al. ..... 400/175
4,389,129 6/1983 Sugiura ..... 400/175

FOREIGN PATENT DOCUMENTS 57-157761 9/1982 Japan ..... 400/175
59-14961 1/1984 Japan ..... 400/175

*Primary Examiner*—Edgar S. Burr

*Assistant Examiner*—David A. Wiecking

*Attorney, Agent, or Firm*—Yount & Tarolli

[57] ABSTRACT

This invention relates to a device for mounting a printing type array on a printer. The mounting device comprises a pin supported on the casing of a printing type array for moving into and out of a hole in the printing type array under and against resilient force, respectively, a pressure member secured to the machine framework for urging the pin into the hole in the printing type array, a motor movably supported on a carriage and having a rotary shaft including a flange and a latch pin normally subjected to resilient force to protrude from one face of the flange and retract from the one face of the flange against resilient force and resilient retainer means on the motor rotary shaft and printing type array for preventing the printing type array from moving in the axial-direction of the shaft as the motor moves to the operative position and for allowing the printing type array to rotate together with the shaft as the shaft rotates.

11 Claims, 6 Drawing Figures

DEVICE FOR MOUNTING PRINTING TYPE ARRAY ON PRINTER

BACKGROUND OF THE INVENTION

This invention relates to a printer and more particularly to a device on the printer for mounting a printing type array such as a printing wheel having a plurality of printing types supported on the outer periphery thereof.

Generally, when a printing wheel having a plurality of printing types supported on and radially extending from the outer periphery thereof is mounted on the rotary shaft of a motor in a printer for rotating the printing wheel, the printing wheel is manually rotated about the rotary shaft until the wheel mounted on the shaft is in a predetermined position, that is, the wheel has to be manually positioned and thus, a rather long time is required by an unskilled worker in positioning the printing wheel.

Therefore, it has been known that the printing wheel may be received in a cassette with the printing wheel in the cassette then being mounted on the rotary shaft. However the cassette type printing wheel has a disadvantage in that the cost of the cassette type printing wheel increases by that for the cassette.

SUMMARY OF THE INVENTION

Therefore, the present invention is to provide a device for mounting a printing type array on the rotary shaft of the motor in a printer which eliminates the disadvantage inherent in the prior art printing type array mounting device referred to hereinabove.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
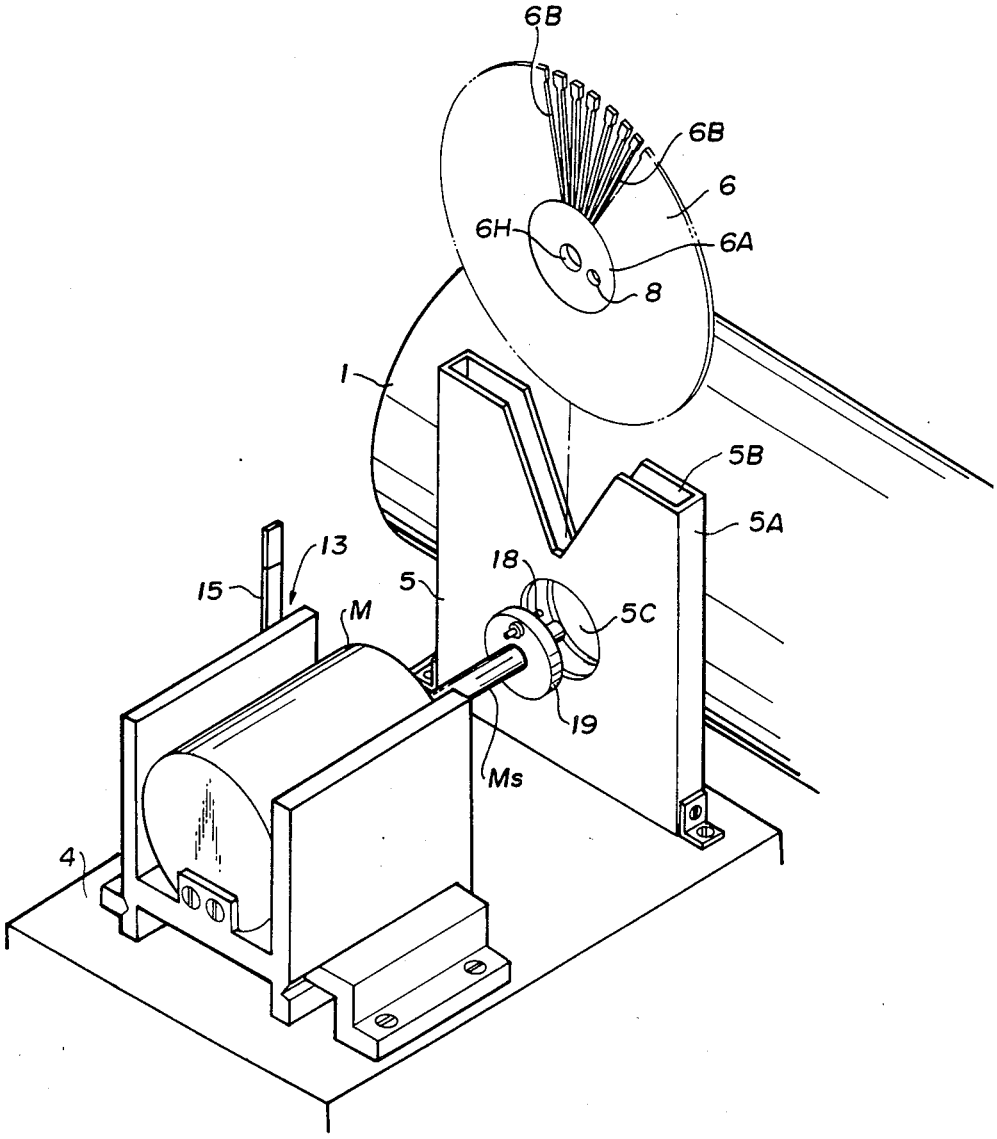
FIG. 1 is a perspective view of one embodiment of the printing type array mounting device in a printer according to the present invention with the printing type array removed from the casing.

The present invention will be now described referring to the accompanying drawings which show one embodiment of the invention for illustration. First referring to FIGS. 1 and 2 thereof, reference numeral 1 denotes a platen supported on the machine framework of a printer (not shown) for rotation about a fixed axis and reference numerals 2, 3 denote carriage guides supported in the machine framework in parallel to the platen and to each other. A carriage 4 is freely received on the carriage guide 2, 3 for reciprocal movement parallel to the platen 1. A printing type assembly 5 is fixedly secured to the carriage 4 adjacent to one side edge thereof and comprises a vertically extending fattened hollow casing or housing 5A defining an elongated opening 5B at the top and having a central circular through opening 5C.

The printing type assembly 5 further includes a printing type array 6 which comprises a central circular support member 6A and a plurality of resilient plates 6B extending radially outwardly from the support member 6A each supporting a printing type at the leading end. The circular support member 6A is formed with a center through opening 6H for the purpose described hereinafter. An inverted U-shaped resilient latch spring 7 is secured to one or the outer surface of the support member 6A surrounding the center opening 6H. The support member 6A for the printing type supporting resilient plates 6B has a small alignment hole 8 positioned radially outwardly from the central opening 6H in the support member 6A.

Reference numeral 9 denotes a base or locating pin formed at the inner end of a resilient piece 10 integrally formed with the casing 5A and having a diameter appropriate for being engaged in the through hole 8 in the support member 6A. The index pin 9 lies in the circle having its radius extending from the center of the support member 6A to the center of the alignment or locating hole 8 and is normally urged out of the hole 8 in the support member 6A under the force of the resiliency of the resilient spring piece 10. When the resilient spring piece 10 is depressed against its own resiliency, the base pin 9 engages in the alignment hole 8.

Figure 2:
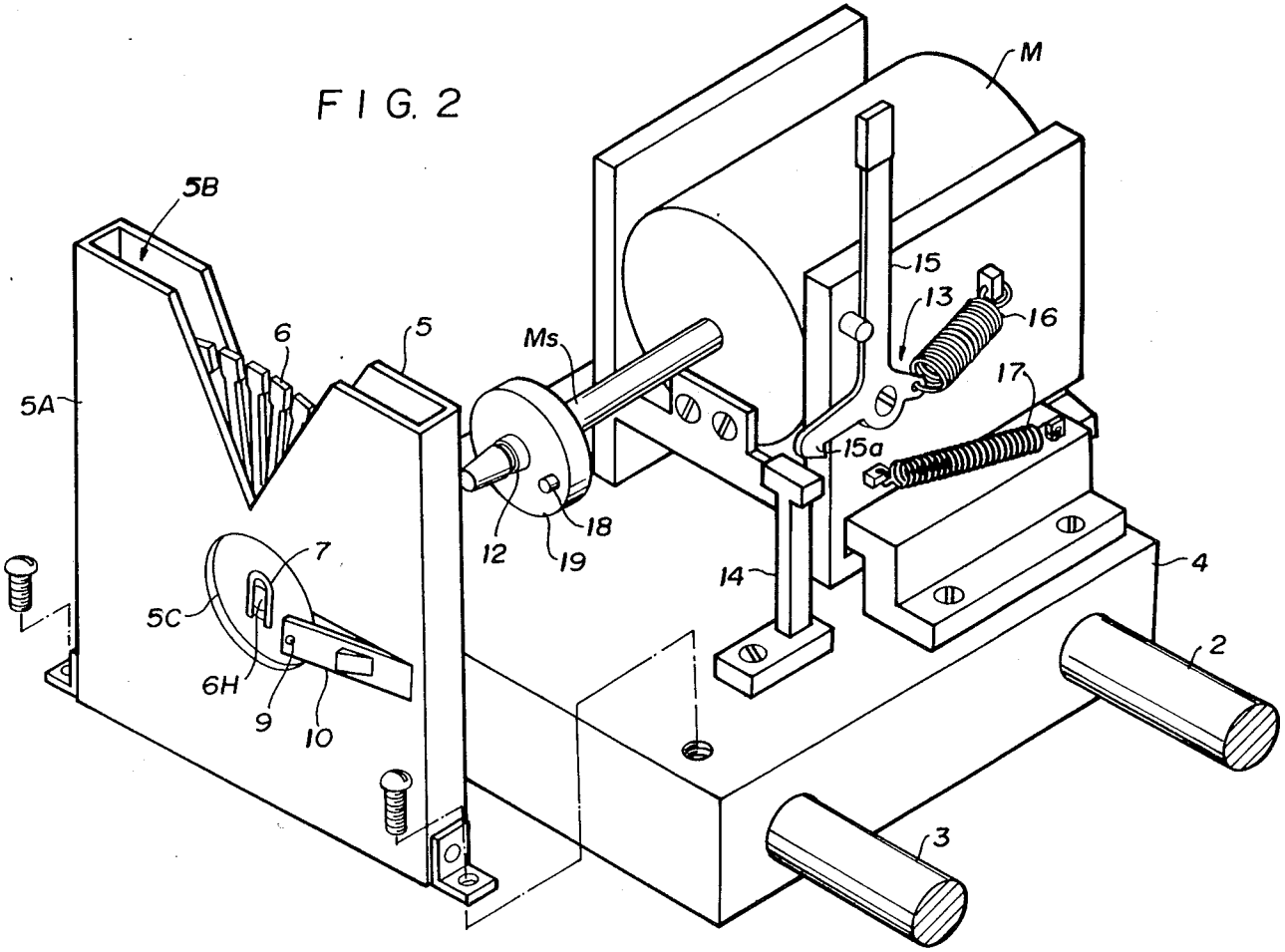
FIG. 2 is a fragmentary exploded perspective view of said printing type array mounting device as shown in FIG. 1.

Reference numeral 11 (FIGS. 5 and 6) denotes a pressure or actuating member secured to the machine framework K in a suitably selected position thereof and adapted to contact the upper surface of the resilient spring piece 10 so as to depress the resilient spring piece against its own resiliency thus urging the base pin 9 into the through alignment hole 8 in the printing array 6 in response to the movement of the carriage 4 to a particular position (the left-most position as seen in FIG. 2). Reference character M denotes a stepping motor supported on the carriage 4 for horizontal movement in a path at right angles to the movement path of the carriage 4 and positioned on the side of the printing type assembly 5 opposite to that which faces the platen 1. The rotary shaft Ms of the stepping motor M is formed at the leading end thereof with an annular recess 12 in which the latch spring 7 on the printing type array 6 engages.

The latch spring 7 and annular groove 12 cooperate with each other to form retainer means P which pinches the rotary shaft Ms so as to hold the printing type array 6 against movement in the axial direction of the rotary shaft of the motor M (the displacement direction of the motor M) as the motor M moves to its operative position, and at the same time allow the printing type array 6 to rotate together with the rotary shaft Ms.

Reference numeral 13 generally denotes a stopper mechanism for holding the motor M in a position in which the latch spring 7 on the printing type array 6 engages in the annular groove 12 in the rotary shaft Ms of the motor M and the stopper mechanism comprises an upright anchor rod 14 secured to the carriage 4, a stop lever 15 which is bifurcated at the lower end with one of the bifurcations having a hook 15*a* for engaging with the anchor rod 14 and a first spring 16 interposed between and anchored to the stop lever 15 and motor M for normally urging the stop lever 15 to rotate in the counter-clockwise direction.

Disposed between and secured to the motor M and carriage 4 is a second spring 17 which has a resiliency sufficient to move the motor M to its inoperative position, in which the latch spring 7 on the printing type array 6 disengages from the annular groove 12 in the motor rotary shaft Ms in response to the disengagement of the stop lever 15 from the anchor rod 14.

Reference numeral 18 denotes a latch or index pin supported in a flange 19 fixedly mounted on the motor rotary shaft Ms for movement in the axial direction of the rotary shaft and the latch or index pin 18 is so positioned that it lies in the rotational movement path of the through hole 8 in the support member 6A of the printing type array 6 when the motor M has moved to its operative position. The latch pin 18 is normally urged to protrude from the front face of the flange 19 under the force of a third spring 20 (FIGS. 5 and 6) which has a resiliency stronger than the resiliency of the pin 9 positioned between the printing type array support member 6A and latch pin 18. The arrangement is so made that when the flange 19 and the support member 6A of the printing type array 6 contact each other, the latch pin 18 retracts from the front face of the flange 19 against the force of the spring 20 and when the motor M rotates until the point where the latch pin 18 is in alignment with the through hole 8 in the type array support member 6*a*, the index pin 18 moves along the axis of rotation of the drive shaft Ms and enters the hole 8.

The operation of the printer having the printing type array mounting device of the invention will be now described.

It is assumed that the printer is now in its inoperative position as shown in FIG. 2.

Figure 3:
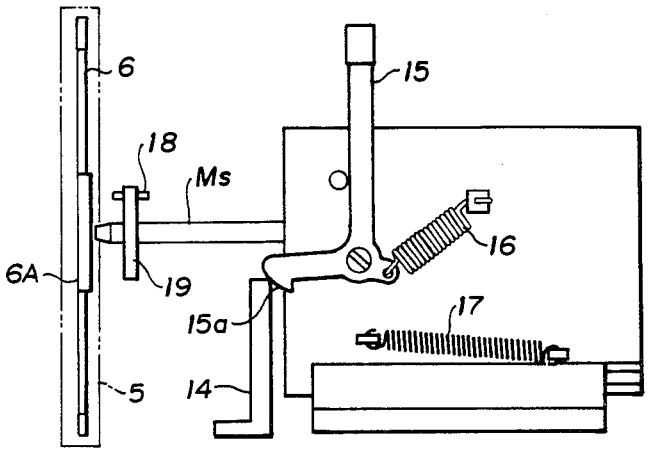
FIG. 3 is a side elevational view of the motor in its inoperative position.
Figure 4:
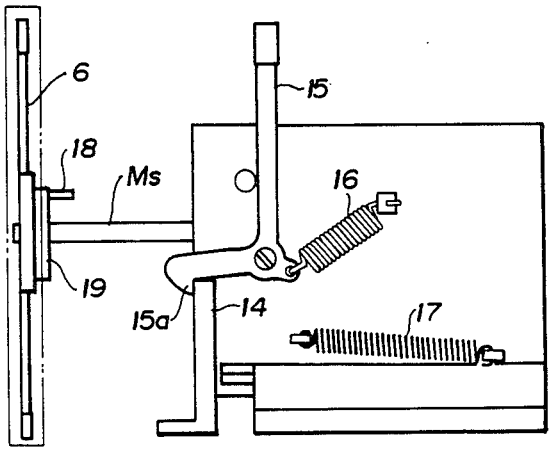
FIG. 4 is similar to FIG. 3, but shows the motor in its operative position.

When the printing type array 6 is inserted into the casing 5A via the opening 5B, the printer assumes the condition as shown in FIG. 3.

Thereafter, the motor M is advanced towards the printing type assembly 5 against the force of the second spring 17 until the annular groove 12 in the rotary shaft Ms of the motor M is engaged by the latch spring 7 on the printing type array 6 whereby the printing type array 6 is held on the rotary shaft Ms.

Figure 5:
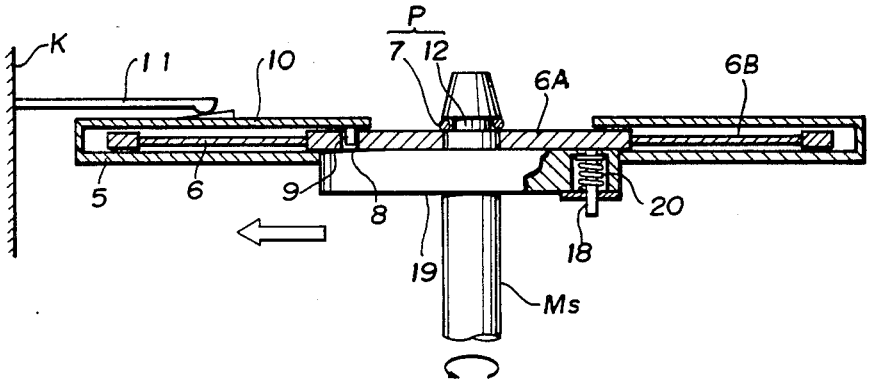
FIG. 5 is a horizontally cross-sectional view showing the pin engaged in the through hole in the printing type array.
Figure 6:
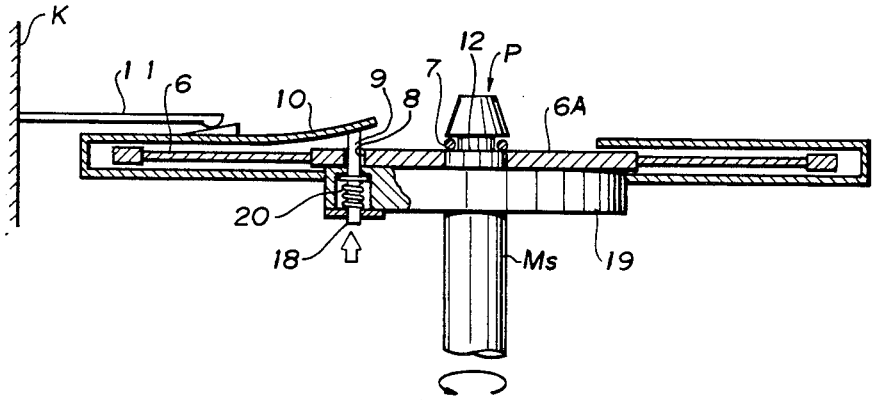
FIG. 6 is a horizontally cross-sectional view showing the latch pin engaged in the through hole in the printing type array.

Simultaneously, the flange 19 and the support member 6A of the printing type array 6 contact each other and the latch pin 18 retracts from the front face of the flange 19 against the force of the third spring 20. Thereafter, when the carriage 4 is moved to its predetermined left-most position as seen in FIGS. 5 and 6, the upper surface of the resilient piece 10 formed on the casing 5A of the printing type assembly 5 contacts the leading end of the pressure member 11 whereby the pin 9 formed at the leading end of the resilient piece 10 moves into the rotational path of the through hole 8 in the support member 6A of the printing type array 6.

Next, when the motor M is rotated, since the printing type array 6 which is now connected to the motor rotary shaft Ms rotates together with the rotary shaft, the through hole 8 in the printing type array 6 engages the pin 9 in the course of the rotation of the printing type array 6 (see FIG. 5) whereby the rotation of the printing type array 6 is arrested to allow only the motor rotary shaft Ms to continue to rotate.

Thus, the latch pin 18 supported on the motor rotary shaft Ms rotates along the rotational path of the through hole 8 in the support member 6B of the printing type array 6 until the latch pin 18 aligns with the hole 8 whereupon the pin 18 is caused to enter the through hole 8 to thereby mount the printing type array 6 on the motor rotary shaft Ms in a predetermined positon.

At this time, the pin 9 at the leading end of the resilient piece 10 is forced out of the through hole 8 as the result of the entry of the latch pin 18 into the through hole 8 and the pin 9 disengages from the printing type array 6 and the printing type array 6 rotates together with the motor rotary shaft Ms to enable a correct printing type to be accurately selected for a particular printing operation.

As mentioned hereinabove, according to the present invention, when the carriage is moved to a predetermined position, the latch pin acts to arrest the rotation of the printing type array 6 received within the casing 5A and next, when the motor having the printing type array mounted thereon is rotated, the latch pin on the flange of the motor rotary shaft engages in the through hole in the printing type array to properly position the motor rotary shaft and printing type array relative to each other. Thus, any manual positioning and mounting of the printing type array can be eliminated and any unskilled worker can replace the printing type array in a short period of time.

It will be understood that various changes may be made in the invention without departing from the spirit thereof.

What is claimed is:

1. In a printing apparatus including a carriage, means for supporting said carriage for reciprocal movement along a linear path, a rotatable disc-shaped printing type array disposed on said carriage and having a center support section with a central opening and an alignment opening offset to one side of the central opening, drive means disposed on said carriage for rotating said printing type array, said drive means including a rotatable drive shaft, the improvement comprising base pin means for engaging the alignment opening in said printing type array when said printing type array is in a predetermined orientation relative to said carriage, said base pin means including a base pin having an end surface and resilient means for maintaining said base pin in the alignment opening until a force in excess of a first force is applied against the end surface of said base pin, and indexing pin means for moving said base pin out of the alignment opening and engaging the alignment opening when said printing type array and drive shaft are in a predetermined orientation relative to each other, said indexing pin means including an index pin connected with said drive shaft for rotation therewith, said index pin having an end surface which is engageable with the end surface of said base pin when said printing type array and drive shaft are in the predetermined orientation relative to each other, and means for pressing the end surface of said index pin against the end surface of said base pin with a force which is greater than the first force when said printing type array and drive shaft are in the predetermined orientation relative to each other to move said base pin out of the alignment opening under the influence of force applied against said base pin by said index pin.

2. A printing apparatus as set forth in claim 1 wherein said resilient means includes a spring member which is connected with said base pin and is resiliently deflectable from a first position toward said printing type array to a second position, said apparatus further including an actuating means for deflecting said spring member from the first position to the second position upon movement of said carriage to a predetermined position along the linear path, said spring member being resiliently deflectable away from said printing type array under the influence of the force applied against said base pin by said index pin when said printing type array and drive shaft are in the predetermined orientation relative to each other.

3. A printing apparatus as set forth in claim 2 wherein the end surface of said base pin is disposed in abutting engagement with said printing type array when said spring member is in the second position with said printing type array in an orientation other than said predetermined orientation relative to said carriage.

4. An apparatus as set forth in claim 2 further including a casing means connected with said carriage and having an open ended cavity for receiving said printing type array, said casing having a central opening which is aligned with the opening in said printing type array when said printing type array is in the predetermined orientation relative to said carriage, said drive shaft being axially movable through the central opening in said casing means into engagement with the central opening in said printing type array, said means for pressing the end surface of said index pin against the end surface of said base pin including means for connecting said index pin with said drive shaft for movement therewith into abutting engagement with said printing type array and for enabling relative movement to occur between said index pin and said drive shaft during continued axial movement of said drive shaft after said index pin abuttingly engages said printing type array, said drive shaft and index pin being rotatable relative to said printing type array to move said index pin into alignment with the alignment openings in said printing type array.

5. A printing apparatus comprising a housing, a type wheel rotatably supported in said housing, said type wheel having a central opening extending between first and second sides of said type wheel and an alignment opening spaced apart from the central opening and extending between the first and second sides of said type wheel, said type wheel being rotatable relative to said housing from a nonaligned position to an aligned position in which said type wheel is in a predetermined orientation relative to said housing, a rotatable drive shaft extending through the central opening in said type wheel, said drive shaft being rotatable relative to said type wheel from a nonindex position to an index position in which said drive shaft is in a predetermined angular orientation relative to said type wheel, drive means for rotating said drive shaft relative to said housing, connector means for connecting said type wheel with said drive shaft to rotate said type wheel with said drive shaft relative to said housing from a nonaligned position to the aligned position and for enabling said drive shaft to rotate relative to said type wheel when said type wheel is held against rotation relative to said housing, locating means for slidably engaging the first side of said type wheel during rotation of said type wheel with said drive shaft toward the aligned position of said type wheel, for engaging the alignment opening when said type wheel is rotated to the aligned position by said drive shaft, and for holding said type wheel against rotation from the aligned position during rotation of said drive shaft relative to said type wheel to the index position after engagement of said locating means with the alignment opening in said type wheel, index means connected with said drive shaft and offset from the axis of rotation of said drive shaft for applying force against said locating means at the alignment opening to move said locating means out of engagement with said alignment opening upon rotation of said drive shaft to the index position, said index means including an index pin movable relative to said drive shaft and means for moving said index pin along the axis of rotation of said drive shaft into the alignment opening in said type wheel upon rotation of said drive shaft to the index positon, said index pin having surface means for slidably engaging the second side of said type wheel during rotation of said drive shaft relative to said type wheel toward the index position and for engaging said locating means during movement of said index pin along the axis of rotation of said drive shaft into the alignment opening in said type wheel.

6. A printing apparatus as set forth in claim 5 wherein said means for moving said index pin along the axis of rotation of said drive shaft includes spring means for pressing said surface means against said type wheel and against said locating means with sufficient force to move said locating means out of the alignment opening.

7. A printing apparatus as set forth in claim 5 further including spring means for urging said locating means toward a position in which said locating means is spaced apart from said type wheel and said type wheel is rotatable relative to said housing, and means for moving said locating means toward said type wheel against the influence of said spring means to press said locating means against the first side of the type wheel during rotation of said type wheel toward the aligned position of said type wheel and to press said locating means into the alginment opening when said type wheel is rotated to the aligned position.

8. A method of positioning a drive shaft and a type wheel relative to each other, aaid method comprising the steps of providing a type wheel which is rotatably mounted in and has a random anSular orientation relative to a housing, engaging the type wheel with a rotatable drive shaft which has a random angular orientation relative to the type wheel, rotating the type wheel to a predetermined angular orientation relative to the housing by rotating the type wheel and drive shaft together relative to the housing, engaging an alignment opening disposed in the type wheel at a location offset from the axis of rotation of the type wheel with a locating pin upon rotation of the type wheel to the predetermined orientation relative to the housing and while the drive shaft is disposed in engagement with the type wheel, thereafter, rotating the drive shaft to a predetermined angular orientation relative to the type wheel by rotating the drive shaft and an index pin together relative to the type wheel, said step of rotating the drive shaft and index pin together includes the step of rotating the index pin about the axis of rotation of the drive shaft, blocking rotation of the type wheel with the locating pin while performing said step of rotating the drive shaft and index pin together, pressing the index pin against the locating pin upon rotation of the drive shaft to the predetermined angular orientation relative to the type wheel, and moving the locating pin out of the alignment opening under the influence of force applied against the locating pin by the index pin while the drive shaft is in the predetermined angular orientation relative to the type wheel and while the type wheel is in the predetermined angular orientation relative to the housing.

9. A method as set forth in claim 8 further including the steps of pressing the index pin against a surface of the type wheel and sliding the index pin along the surface of the type wheel while performing said step of rotating the drive shaft and index pin together relative to the type wheel.

10. A method as set forth in claim 8 wherein said step of moving the locating pin out of the alignment opening includes moving the index pin relative to the drive shaft.

11. A method as set forth in claim 8 further including the step of maintaining the drive shaft and type wheel in containuous engagement from the time of performance of said step of engaging the tyep wheel with a rotatable drive shaft to completion of said step of moving the locating pin out of the alignment opening.

* * * * *